United States Patent [19]

Hampton

[11] Patent Number: 4,589,802

[45] Date of Patent: May 20, 1986

[54] SLIP ASSEMBLY FOR SUBSEA TEMPLATE

[75] Inventor: James E. Hampton, Peterculter, Scotland

[73] Assignee: Sedco, Inc., Dallas, Tex.

[21] Appl. No.: 450,991

[22] Filed: Dec. 21, 1982

Related U.S. Application Data

[63] Continuation-in-part of Ser. No. 292,014, Aug. 11, 1981, Pat. No. 4,435,108.

[51] Int. Cl.[4] ..... E02B 17/02

[52] U.S. Cl. ..... 405/227; 405/224

[58] Field of Search ..... 405/195, 196, 199, 224, 405/227, 228; 188/67

[56] References Cited

U.S. PATENT DOCUMENTS

| | | | |
|---|---|---|---|
| 3,987,638 | 10/1976 | Burkhardt et al. | 405/203 |
| 4,062,313 | 12/1977 | Stram | 114/265 |
| 4,332,062 | 6/1982 | Byrne | 188/67 |
| 4,405,261 | 9/1983 | Lawson | 405/227 |
| 4,408,932 | 10/1983 | Cowan | 405/227 |

FOREIGN PATENT DOCUMENTS

| | | |
|---|---|---|
| 615015 | 12/1948 | United Kingdom . |
| 998224 | 7/1965 | United Kingdom . |
| 1291816 | 10/1972 | United Kingdom . |
| 1505184 | 3/1978 | United Kingdom . |
| 2009815 | 6/1979 | United Kingdom . |
| 1556776 | 11/1979 | United Kingdom . |
| 2026577 | 2/1980 | United Kingdom . |
| 2054710 | 2/1981 | United Kingdom . |

*Primary Examiner*—David H. Corbin

*Attorney, Agent, or Firm*—Hubbard, Thurman, Turner & Tucker

[57] ABSTRACT

A slip assembly particularly adapted for use in conjunction with forming a supportive connection between a subsea template or related support structure and support pilings for the template. The slip assembly comprises a floating slip bowl for receiving a plurality of cylindrical slip segments which are movable radially inwardly into gripping engagement with a support column or pile member by a hydraulic cylinder actuator assembly which is connected to a cylindrical ring having a link interconnected with each of the slip segments to permit radial inward and outward movement of the segments in response to axial extension and retraction of the actuator. The slip assembly includes an upwardly facing guide funnel for guiding the pile into a central passage through the slip assembly.

15 Claims, 6 Drawing Figures

SLIP ASSEMBLY FOR SUBSEA TEMPLATE

CROSS REFERENCE TO RELATED APPLICATION

This application is a continuation-in-part of prior copending application Ser. No. 292,014, filed: Aug. 11, 1981 now U.S. Pat. No. 4,435,108.

BACKGROUND OF THE INVENTION

1. Field of the Invention

The present invention pertains to a hydraulically actuated slip assembly for securing a subsea well structure such as a drilling template or the like to a pile or support column.

2. Background

In the art of developing offshore petroleum deposits and the like it has become particularly important to be able to locate and properly anchor structures such as drilling and foundation templates to the seabed so that additional structures such as wellheads, guide bases and the like can be properly located on or connected to the templates. In this regard, there has been a need to provide an improved apparatus for securing such templates to the template support columns or piles in a manner which will permit final levelling and adjustment of the template or similar structure but which will also provide for adequately connecting the template to the piles to be securely anchored and supported thereby. The present invention pertains to an improved slip assembly for interconnecting a subsea template to a pile or similar types of support column, which slip assembly may be actuated by remote control to form a supporting connection between the pile and the template structure.

SUMMARY OF THE INVENTION

The present invention provides improved apparatus for interconnecting a pile or support column with a subsea well structure such as a drilling template or the like wherein the template may be disposed in a predetermined position and supported by one or more of said piles. In accordance with one aspect of the invention there is provided a hydraulically actuated slip assembly mounted on a subsea template structure and adapted to receive and forcibly grip a support pile member to form the supporting connection between the pile and the structure to be supported by the pile.

The present invention further provides a slip assembly comprising a slip bowl having an inwardly facing conical surface, a series of slip segments arranged for limited movement axially and radially with respect to the axis of the conical surface, and a fluid operated piston and cylinder type actuator disposed to move the slip segments so that the corresponding radial movement determined by the conical surface causes the slip segments to move into or out of gripping engagement with a cylindrical pile member. The slip bowl is mounted on a supporting frame for limited axial and radial movement with respect to the central axis of the slip assembly to provide for alignment with the axis of the pile. The slip assembly further includes a guide funnel for guiding a cylindrical pile into alignment with the slip bowl during insertion of the pile.

In accordance with one embodiment of the present invention the piston and cylinder type actuator may be of an annular configuration surrounding the pile and adapted to be generaly coaxial with the axis of the slip bowl. In accordance with another embodiment of the present invention the piston and cylinder type actuator may include a plurality of separate piston and cylinder assemblies spaced apart in surrounding relationship to the pile and engageable with the slip members through a connecting member.

In accordance with a still further aspect of the present invention the slip assembly includes an improved mechanism interconnecting the slip segments with the slip actuator and a unique mounting arrangement of the actuator to accommodate and enhance the self aligning characteristics of the slip assembly. The slip assembly is also provided with a locating and mounting flange, preferably disposed at one end of the assembly, for forming a connecting element for mounting the slip assembly on a subsea template or the like.

The present invention further contemplates the provision of a subsea template in combination with one or more pile slip assemblies of the type disclosed herein and wherein the template is adapted for driving the pile through a receiving sleeve in the template, moving the template vertically with respect to the pile, and then gripping the pile with the slip assemblies in accordance with the present invention.

Those skilled in the art will appreciate the features of the invention described hereinabove as well as other superior aspects of the invention upon reading the detailed description which follows in conjunction with the drawings.

DESCRIPTION OF THE PREFERRED EMBODIMENTS

Figure 1:
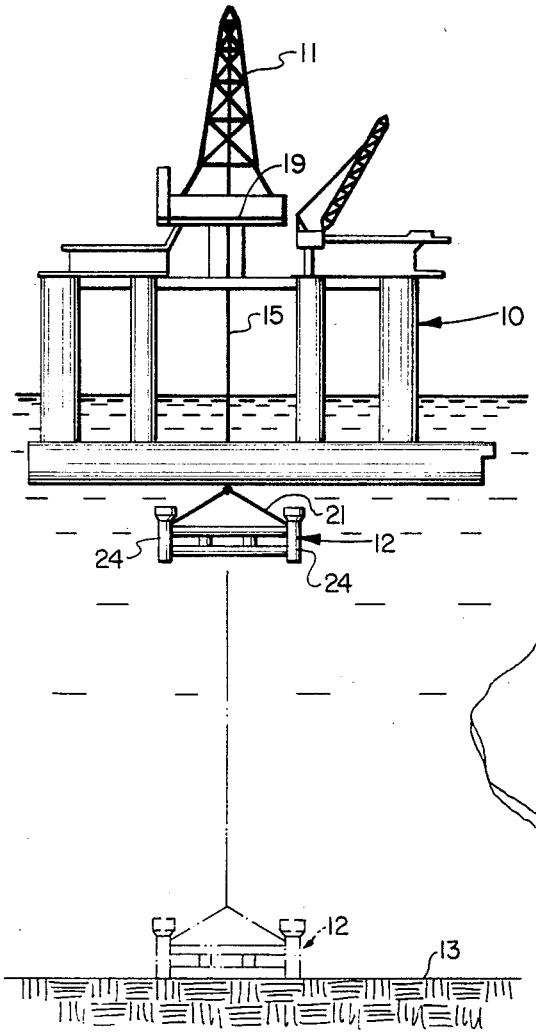
FIG. 1 is a schematic illustration showing the installation of a subsea template using a semi-submersible drilling rig.

In the description which follows like parts are marked throughout the specification and drawings with the same reference numerals, respectively. The drawings are not necessarily to scale and certain features of the invention may be shown in schematic or diagrammatic form in the interest of clarity and conciseness.

Figure 2:
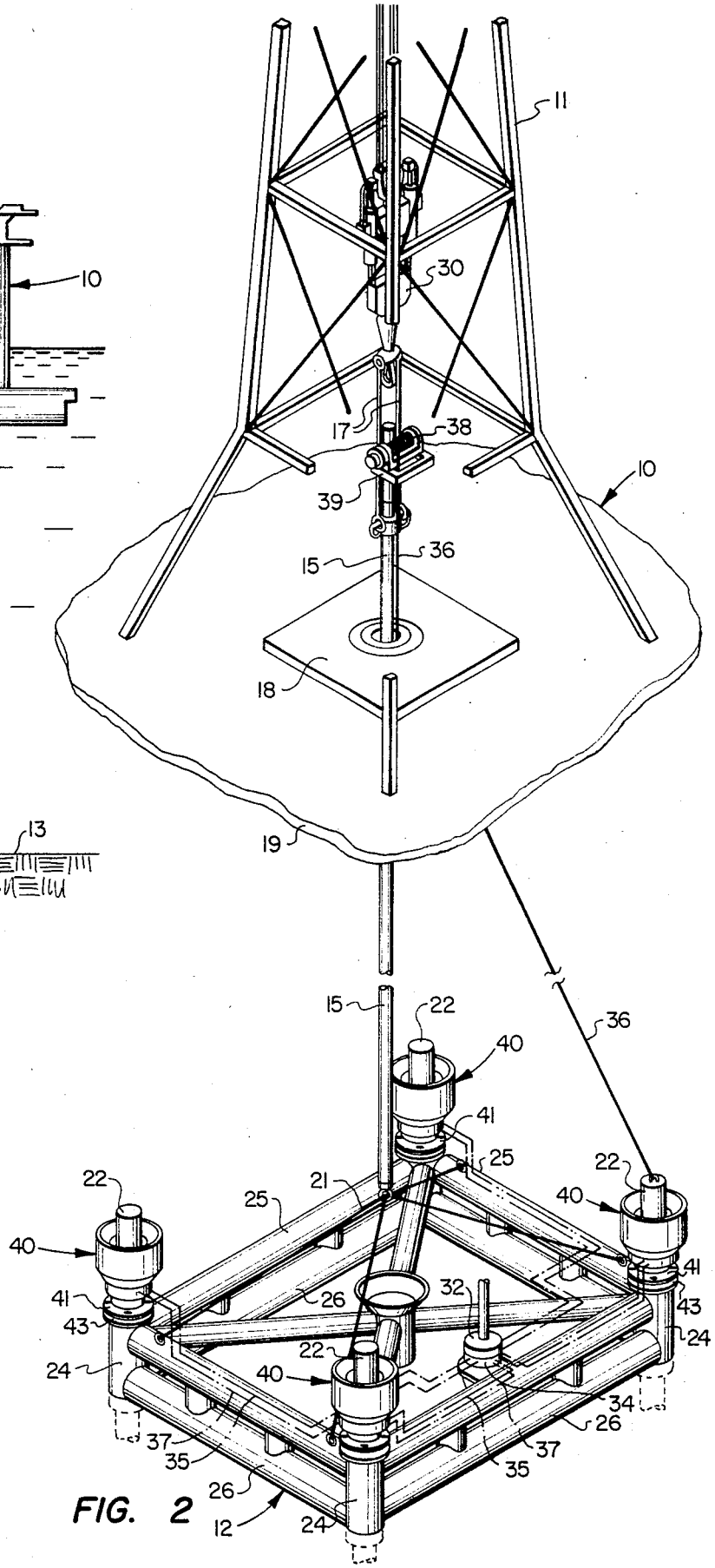
FIG. 2 is a schematic diagram of a portion of the drilling rig shown in FIG. 1 and showing an arrangement on the drilling rig which is used to level the template.

The slip assembly of the present invention will be described in conjunction with some of the steps involved in an improved procedure for lowering and levelling a subsea template from a semi-submersible drilling rig. Referring to FIG. 1, there is illustrated a seagoing semi-submersible drilling rig, generally designated by the numeral 10, which is shown in position for lowering a drilling template 12 toward a seabed 13. The drilling rig 10 is preferably of the submersible hull column stabilized type. The template 12 is preferably suspended from a derrick 11 on the rig and by a suitable riser string 15 suspended from the derrick. The riser string 15 typically extends through a rotary table 18 mounted on a deck or platform 19, as shown in FIG. 2. The drilling rig 10 is also of a type which includes suitable drill stem hoisting and rotating apparatus associated with the derrick 11 for handling a drill stem in a conventional manner for performing drilling operations and for handling elongated risers or tubing strings. The rig 10 is also adapted to utilize the aforementioned hoisting apparatus or additional apparatus for raising and lowering structures such as the template 12. The template 12 is similar in some respects to known types of skeletal framelike structures used as support frames for subsea well drilling and development applications. As shown in FIG. 2, the template 12 includes four spaced apart vertical tubular pile receiving sleeves 24 interconnected by suitable frame members 25 and 26. The template 12 may include additional structure, depending on its specific purpose.

When the drilling rig 10 is disposed in the desired installation position for the template 12, the template is properly oriented and then lowered, using suitable cables or the riser string 15 and a sling assembly 21, as shown in FIG. 2. The sling 21 is connected to the template 12 at points which will preferably place the center of gravity of the template directly below the riser string 15. When the template 12 reaches seabed 13 weight on the riser string 15 is slacked off in increments of approximately 50,000 lbs., for example, until all of the weight is off the riser string and then an additional length of about 30 ft. is slacked off to accommodate settling of the template and assure that there is slack in the lowering structure. If the template is reasonably level, the lifting slings 21 are released and recovered.

At this point, typically, guidance and verification of template position is planned and carried out as a three phase program described in prior copending application Ser. No. 292,014. The guidance phase includes guidance during initial set down and may include an acoustic or sonar type system for determining the exact location of the template using hardwired connections between the drilling rig and the template. Additionally, inclinometer and gyro devices on board the template and hardwired to the drilling rig may be utilized for providing information during levelling and orientation of the template.

When the drilling template 12 has been accurately positioned on the seabed 13 suitable elongated column-like support members or piles 22 are inserted through the respective pile receptacles or sleeves 24 in the template 12, see FIG. 2, in the process of securing the template to the seabed. It may be required to drill a pile receiving hole before lowering one or more of the piles 22 and also perform cementing operations after the pile or piles have been lowered and placed in the receiving holes. These operations may be carried out in a generally conventional manner but may be done with the slip assemblies of the present invention in place on the template by lowering the drill stem through the slip assemblies. Preferably, if the template is more than about two degrees out of level, a suitable tensioning line is connected from a low point on the template to a tensioner assembly on the drilling rig and the template is then levelled to within the required accuracy.

Template levelling can also be carried out using a heave compensator on board the drilling rig 10 or a similar suitable vessel, generally as follows. Referring to FIG. 2 there is illustrated in somewhat schematic form a portion of the rig 10 including the derrick 11 having a suitable heave compensator mechanism 30 suspended therefrom. The levelling procedure is usually carried out after all piles 22 have been drilled, if necessary, run to position and cemented in position and suitable hydraulic lines have been run from the rig 10 to the template 12 for controlling the operation of the improved pile slip assembly of the present invention. FIG. 2 also illustrates a hydraulic control pod 32 connected to a suitable pod receptacle 34 with attendant hydraulic conduits running from the rig 10 through the pod to each of the slip assemblies which are respectively designated by the numeral 40. The control pod and receptacle may be of a general type commercially available, and comprising no part of the present invention per se are not believed to require a detailed description. The levelling procedure is described in detail in a copending application filed concurrently herewith and incorporated by reference herein. However, basically the levelling procedure is carried out also using riser string 15 suitably connected to the template 12 at its center of gravity through sling 21, for example, and a tensioning line 36 attached to one corner of the template as indicated schematically in FIG. 2. The riser string 15 is connected to bails 17 suspended from the hook of heave compensator 30. The tensioning line 36 is trained upward and is connected to the drum of a constant torque fluid operated winch 38 mounted on a frame 39 supported on the upper end of the riser string 15.

In FIG. 2, the slip assemblies 40 are shown in place supported on top of each of the sleeves 24. The slip assemblies 40 are each provided with a frame having a lower transverse mounting flange 41 adapted to be supported on and bolted or otherwise secured to a cooperating flange 43 secured to the top of each of the pile sleeves 24. The slip assemblies 40 are hydraulically actuated to grip or release the associated piles 22 which are disposed in the pile sleeves 24 and are supplied with hydraulic fluid through the control pod 32 and receptacle 34. The control pod receptacle 34 is suitably supported on the template and interconnected with each of the slip assemblies by way of suitable hydraulic control lines 35 and 37. Accordingly, the slip assemblies 40 may be individually remotely controlled from the surface or other remote location to secure or release the slip assemblies with respect to the piles disposed therein once the template has been positioned. Once the template 12 is properly levelled with each of the piles in place the slip assemblies 40 are suitably actuated to grip the respective piles to secure the template to the piles in the preferred position. Thanks to the arrangement of pile gripping members of the slip assemblies 40, which will be described in further detail herein, the weight of the template is effective to somewhat self-energize the slip assemblies to secure the template to the pilings once the gripping members are forcibly engaged with the pile regardless of whether or not hydraulic fluid is continuously supplied to the templates.

Figure 3:
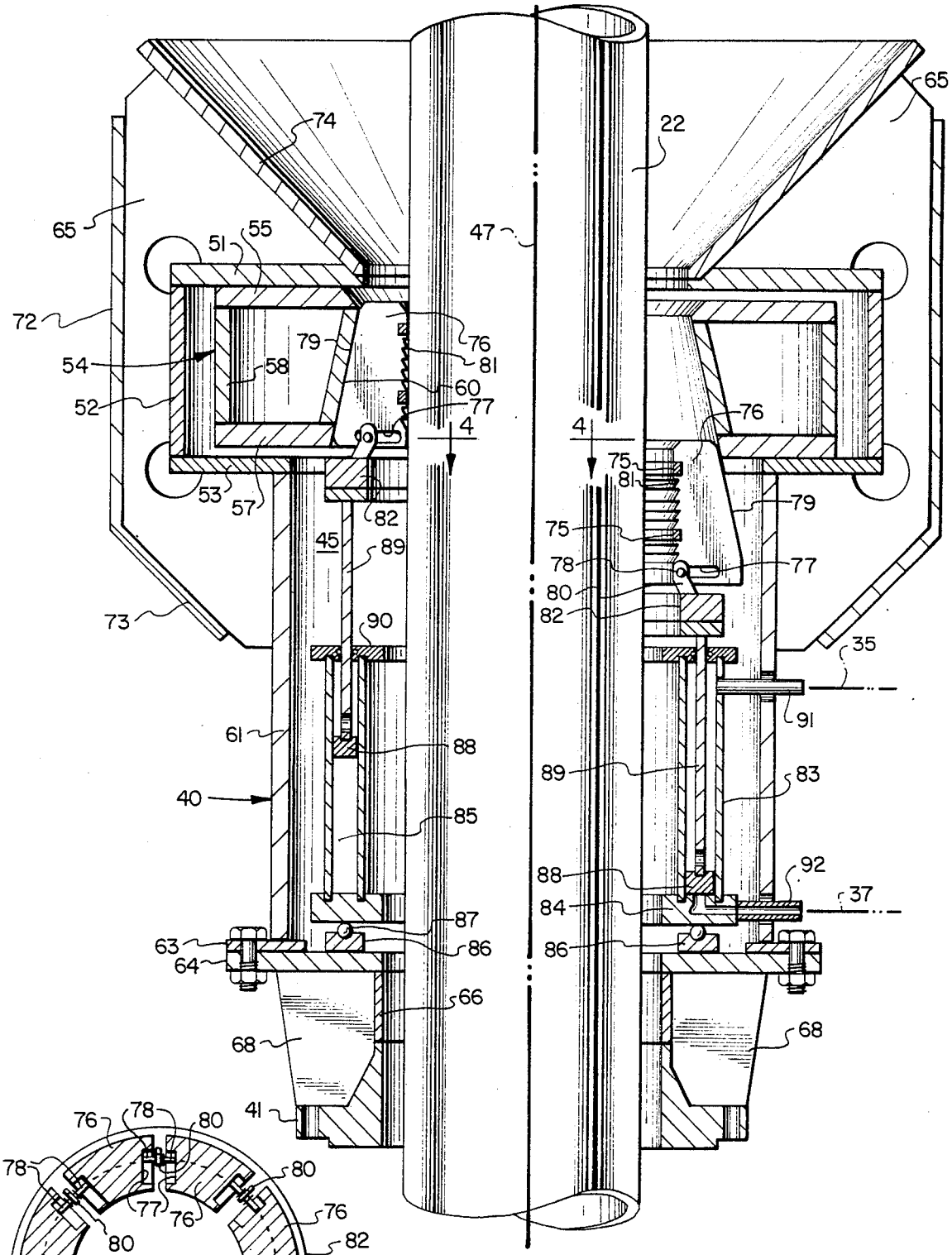
FIG. 3 is a longitudinal central section view of one embodiment of a pile slip assembly wherein the left half of the view shows the assembly in an engaged condition and the right half shows the assembly in a retracted condition with respect to a cylindrical pile.

Referring to FIG. 3, one preferred embodiment of a slip assembly 40 according to the present invention is illustrated in a split longitudinal section view. The slip assembly 40 is adapted to surround a pile 22 and to grippingly engage the pile as will be evident from the following description. The slip assembly 40 includes a frame comprising upper and lower ring shaped abutment plates 51 and 53, respectively, which are secured to and spaced apart by a cylindrical tubular wall member 52. An annular slip bowl 54 is disposed within the enclosure formed by the frame plates 51 and 53 and includes upper and lower plates 55 and 57 which are spaced apart by an outer cylindrical wall 58 and a conically tapered inner wall 60. The slip bowl 54 fits loosely between the plates 51 and 53 and is operable to center itself radially with respect to the longitudinal central axis 47 of the slip assembly which coincides in the view of FIG. 3 with the central axis of a pile 22. The slip bowl 54 is also operable to move axially and to tilt with respect to the central axis of the slip assembly within the limits imposed by the frame plates 51 and 53 to accommodate some skew misalignment of the pile with respect to the slip assembly.

The lower plate 53 is supported by a cylindrical tubular frame member 61 which is secured to a mounting ring 63 and defines a receptacle 45 in which the pile 22 is disposed together with an actuator for the slip assembly to be described herein. The mounting ring 63 is supported by and secured to a base plate 64. The base plate 64 is supported on and secured to a sleeve 66 and the locating flange 41 by a plurality of radially extending gusset plates 68. Referring further to FIG. 3 the slip assembly 40 is also provided with a cylindrical outer housing member 72 disposed around the frame portion formed by the plates 51 and 53 and fixed thereto by a plurality of radially projecting gusset plates 65, opposed ones of which are shown in FIG. 3. The gussets 65 are also secured to lower and upper conical plates 73 and 74, disposed below and above the housing member 72, as shown. The conical plate 74 forms a guide funnel for guiding a pile 22 into the central receptacle in the frame of the slip assembly.

Figure 4:
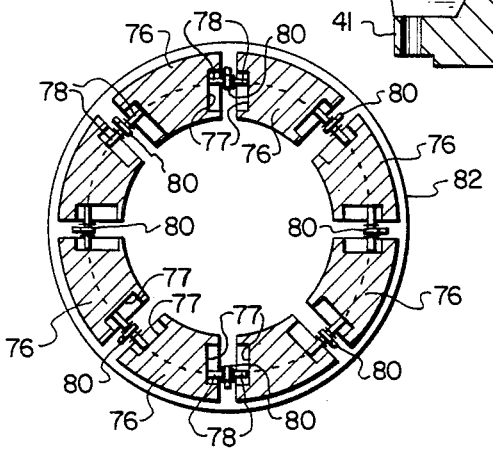
FIG. 4 is a section view taken along line 4—4 of FIG. 3 showing the slip segments in the position shown in the left side of FIG. 3.

Referring to FIGS. 3 and 4, the slip assembly 40 is also provided with a plurality of slip segments 76 which are disposed generally within the tapered slip bowl wall 60 in surrounding relationship to the pile 22. The segments 76 are preferably formed of case hardened steel and are arranged to engage the pile 22 as shown by the position of one of the slip segments on the left side of the central axis 47 of the slip assembly in FIG. 3. The slip segments 76 are each in the form of a circular segment or sector portion, are preferably provided eight in number and are interconnected and biased outwardly against the wall 60 by suitable annular resilient retaining springs 75 fitted in cooperating grooves in the inner wall surfaces of the slip segments. The springs 75 may be formed as a resilient steel split ring, for example, not unlike a piston ring and operable to bias the slip segments radially outward with respect to the axis 47 against the inner wall 60 of slip bowl 54. The segments 76 include a sloping outer wall 79 and a cylindrical wall 81, the latter being provided with a series of gripping teeth or serrations for gripping the surface of the pile 22. As shown in FIGS. 3 and 4, the segments 76 are also provided with slots 77 formed in the opposed sidewalls of the segments. The slots 77 are adapted to receive link means comprising oppositely projecting trunnions 78 which are attached to spaced apart brackets 80 mounted on a circular guide ring 82.

The slip assembly 40 further includes hydraulic actuator means comprising an annular hydraulic cylinder 83 having a lower head member 84 which is supported on an anti-friction ball bearing assembly including a ball housing 86 supported on the base plate 64 and adapted to include bearing elements 87. The cylinder 83 is adapted to form a chamber 85 having an annular piston 88 disposed therein and connected to a piston rod portion 89 which is vertically extendable and retractable with respect to the cylinder through an upper head member 90 and is in supportive relationship with the guide ring 82. Pressure fluid is supplied to cylinder 83 to act alternately on opposed faces of the piston 88 through suitable conduits 91 and 92, respectively.

In response to application of pressure fluid into the portion of annular cylinder chamber 85 formed below the piston 88, viewing FIG. 3, the guide ring 82 is moved upwardly which in turn moves the slip segments 76 against the tapered inner wall 60 to force the segments radially inwardly into gripping engagement with the outer circumferential surface of the pile 22. Thus, the effect of increased hydraulic pressure in the lower chamber of the cylinder 83 is to force the slips segments 76 inwardly against the resistance of the retaining springs 75 into gripping engagement with the pile as the upper slip bowl plate 55 is forced into engagement with the frame plate 51. Thanks to the arrangement of the floating slip bowl 54 some misalignment of the pile 22 with respect to the central longitudinal axis of the slip assembly may be tolerated when the slip assembly is mounted on a template such as the template 12. The cylinder 83 may also undergo lateral excursion with respect to the central axis 47 of the slip assembly to accommodate movement of the slip bowl and the slip segments. In the retracted condition of the slip segments 76 the upper edges of the segments normally remain engaged with the slip bowl 54 as shown by the view to the right of the central axis in FIG. 3.

Figure 5:
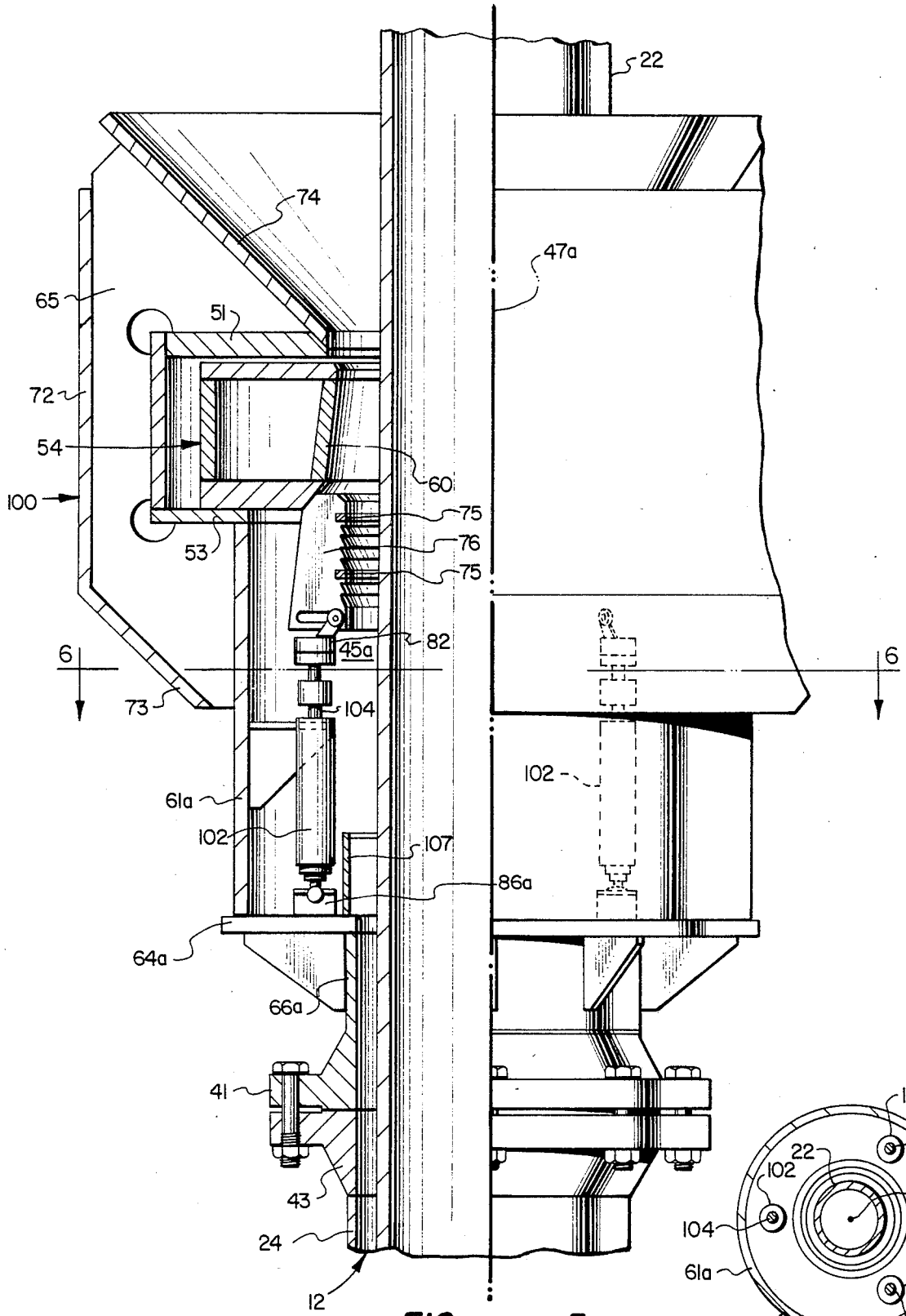
FIG. 5 is a side elevation, partially sectioned, of an alternate embodiment of a slip assembly in accordance with the present invention.
Figure 6:
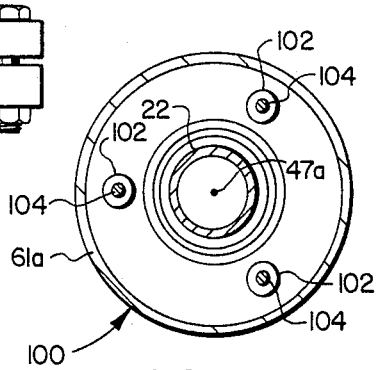
FIG. 6 is a detail section view taken along the line 6—6 of FIG. 5.

Referring now to FIGS. 5 and 6, an alternate embodiment of a slip assembly is illustrated and generally designated by the numeral 100. The slip assembly 100 includes several components which are identical to corresponding components in the slip assembly 40. The slip assembly 100 also includes components which are generally functional counterparts of the components of the slip assembly 40 and each of which are designated with the same reference numeral but having a suffix "a". The slip assembly 100 includes a plurality of separate hydraulic cylinder assemblies 102 which are spaced apart circumferentially within the chamber formed by a frame tube **61*a*. The cylinder assemblies 102 include piston rods 104 which are connected to a guide ring 82 having brackets 80 with trunnions 78 slidable in radially extending slots 77 in slip segments 76 corresponding to the arrangement of the slip assembly 40. The cylinder assemblies 102 are preferably double acting mechanical locking type and are interconnected by a suitable hydraulic circuit, not shown, in parallel with each other wherein each of the associated piston rods 104 may be extended under the same urging force to cause the slip segments 76 to move radially inwardly as they engage the inner wall 60 of the slip bowl 54 to move into gripping engagement with a pile 22. The cylinder assemblies 102 are preferably provided three in total number spaced apart equidistant with respect to each other around the central axis 47*a* of the slip assembly 100, as shown in FIG. 6. Each cylinder assembly 102 is also mounted on frame plate 64*a* by a ball and socket or knuckle joint 86*a* to permit limited pivotal movement of the cylinder assemblies to accommodate radial displacement of the slip bowl 54 in the event the pile 22 is misaligned with respect to the slip assembly 100. The operation of the slip assembly 100 is similar to that of slip assembly 40. The frame plate 64*a* is welded directly to a sleeve 66*a* and to frame member 61*a***. A tubular sleeve 107 extends upward from plate 64*a* and is adapted to support a running tool during pile hole drilling operations and to prevent back flow of drill cuttings into the interior receptacle 45*a* of the slip assembly in the vicinity of the actuators 102 which, if allowed to accur, might impair their operability.

The slip assembly 100 is adapted for use with relatively large diameter piles, larger than approximately 20 inches nominal diameter. This is due to the fact that the annular cylinder and piston arrangement for the slip assembly 40 is more difficult to design for suitable operation with larger diameter piles. For pile sizes smaller than approximately 20 inches diameter the annular cylinder configuration of the slip assembly 40 is preferred since the space available to house the multiple cylinders 102 typically becomes too small. The slip assembly 100 includes a mounting flange 41 for securing the slip assembly to the flange 43 of a pile sleeve 24 as shown in FIG. 5. A major advantage of the slip assemblies 40 and 100 is that they allow for drilling operations to take place through the slip assembly as well as the subsequent driving of a pile through the slip assembly.

One way of releasing the slip assemblies 40 or 100 from the piles 22 would be to pull upward on the template 12 to release the downward force of the slip bowl 54 on the slip segments while reversing the direction of movement of the actuators 83 or 102 to allow the annular springs 75 to urge the slip segments 76 radially outward while they are pulled axially downward, viewing FIGS. 3 and 5, respectively.

Those skilled in the art will appreciate that various substitutions and modifications may be made to the embodiments of the invention described herein without departing from the scope and spirit of the invention as recited in the appended claims.

What I claim is:

1. A slip assembly for interconnecting a subsea template or the like to a support pile, said slip assembly comprising:

a frame including means defining a receptacle for receiving a pile extending longitudinally through said frame, said frame including means for supporting said slip assembly on said template;

a slip bowl comprising a member having a conical surface forming a receptacle for receiving a plurality of slip segments, said slip bowl member being loosely journalled on said frame for limited radial movement to substantially align the central axis of said conical surface with the central axis of a pile disposed through said slip assembly;

a plurality of slip segments having outward facing conical surfaces for engagement with said slip bowl to force said segments into gripping engagement with said pile; and fluid operated cylinder and piston actuator means operably connected to said segments by means for moving said segments axially to engage said slip bowl whereby said segments are moved radially into gripping engagement with said pile.

2. The clip assembly set forth in claim 1 including:

means supporting said actuator means on said frame for limited movement on said frame to actuate said segments to forcibly engage said pile around the outer circumference thereof.

3. The slip assembly set forth in claim 1 including:

a guide funnel disposed at the top of said frame for guiding said pile into said receptacle in said slip assembly.

4. The slip assembly set forth in claim 1 wherein:

said actuator means includes an annular cylinder disposed around said pile and forming a passage defining part of said receptacle for receiving said pile, annular piston means disposed in said cylinder and connected to said means for moving said segments axially to engage said slip bowl and said pile.

5. The slip assembly set forth in claim 1 wherein:

said slip assembly includes a member disposed around said pile and including link means interconnecting said actuator means with said segments and to permit said segments to move radially in response to engaging said slip bowl.

6. The slip assembly set forth in claim 1 wherein:

said actuator means is mounted on bearing means on said frame to permit limited radial movement of said actuator means with respect to the central axis of said slip assembly to accommodate misalignment of said pile.

7. The slip assembly set forth in claim 3 wherein:

said means for supporting said slip assembly on said template includes a mounting flange on said frame below said guide funnel.

8. A slip assembly for interconnecting a subsea template or the like to a support pile, said slip assembly comprising:

a frame including means defining a receptacle for receiving a pile extending longitudinally through said frame, said frame including means for supporting said slip assembly on said template;

a slip bowl comprising a member forming a downwardly facing conical surface forming a receptacle for receiving a plurality of slip segments, said slip bowl member being loosely journalled on said frame for limited radial movement to substantially align the central axis of said conical surface with the central axis of a pile disposed through said slip assembly;

a plurality of slip segments having outward facing conical surfaces for engagement with said conical surface of said slip bowl to force said segments into gripping engagement with said pile in response to axial movement of said segments a guide funnel disposed at the top of said frame for guiding said pile into and through said slip bowl; and a fluid operated cylinder and piston actuator operably connected to said segments by a member disposed around said pile and including link means interconnecting said actuator with said segments and operable to permit said segments to move radially inward into gripping engagement with said pile in response to axial movement of said segments under the urging of said actuator to engage said slip bowl, and means supporting said actuator on said frame for limited movement with respect to said frame in response to actuation of said segments to forcibly engage said pile around the outer circumference thereof.

9. The slip assembly set forth in claim 8 wherein:

said segments are engaged with an annular spring member operable to bias said slip segments radially outward into engagement with said slip bowl.

10. In combination, a subsea template for use in subsea well drilling and production operations, said template comprising a frame including a plurality of spaced apart substantially vertically extending pile receiving sleeves, a hydraulically actuated slip assembly mounted on selected ones of said sleeves for gripping engagement with a pile extending through respective ones of said selected ones of said sleeves whereby said template may be supported with respect to a seabed in a predetermined position, each of said slip assemblies being characterized by a frame including means for supporting said slip assembly on said sleeve, a slip bowl mounted on said frame and including means forming a conical surface for engaging slip means for forcing said slip means into gripping engagement with said pile, means on said frame for supporting said slip bowl for limited movement with respect to said frame to accommodate misalignment of said pile with respect to the central axis of said slip assembly, and fluid operated actuator means for moving said slip means with respect to said slip bowl to forcibly engage said pile in response to introduction of pressure fluid to said actuator means.

11. The combination set forth in claim 10 wherein:

said template includes pressure fluid connector means disposed thereon and conduit means leading from said connector means to respective ones of said slip assemblies for actuating said slip assemblies selectively to engage a pile disposed in each of said respective slip assemblies.

12. A slip assembly for interconnecting a subsea template or the like to a support pile extending to the seabed for supporting said template in a preselected position relative to said seabed, said slip assembly comprising:

a frame including means defining a receptacle for receiving said pile extending longitudinally through said frame, said frame including means for supporting said slip assembly on said template;

a slip bowl comprising a slip bowl member having surface means having a central axis and forming a receptacle for receiving a plurality of slip segments, said slip bowl member being loosely journalled on said frame for limited radial movement to substantially align said central axis of said surface means with the central axis of a pile disposed through said slip assembly;

a plurality of slip segments having outward facing surfaces for engagement with said slip bowl to force said segments into gripping engagement with said pile;

fluid operated cylinder and piston actuator means operably connected to said segments by means for moving said segments axially to engage said slip bowl whereby said segments are moved radially into gripping engagement with said pile, said means for moving said segments includes a ring member disposed around said pile and including link means interconnecting said actuator means with said segments and to permit said segments to move radially in response to engaging said slip bowl, said segments each including a radially extending slot formed therein; and said link means comprises a plurality of trunnions disposed in said slots, respectively, and operable to permit radial movement of said segments while axially moving said segments with respect to said slip bowl.

13. A slip assembly for interconnecting a subsea template or the like to a relatively large diameter cylinder support pile, said slip assembly comprising:

a frame including means defining a receptacle for receiving a pile extending longitudinally through said frame, said frame including means for supporting said slip assembly on said template;

a slip bowl comprising a member forming a surface of said slip bowl having a central axis and defining a receptacle for receiving a plurality of slip segments, said slip bowl member being loosely journalled on said frame for limited radial movement to substantially align the central axis of said surface of said slip bowl with the central axis of a pile disposed through said slip assembly;

a plurality of slip segments having outward facing surfaces for engagement with said surface of said slip bowl to force said segments into gripping engagement with said pile in response to axial movement of said segments;

a plurality of fluid operated cylinder and piston actuators operably connected to said segments by a member disposed around said pile and including link means interconnecting said actuators with said segments and operable to permit said segments to move radially inward into gripping engagement with said pile in response to axial movement of said segments under the urging of said actuators to engage said slip bowl; and means forming a joint between each of said actuators and said frame for supporting said actuators on said frame for limited pivotal movement with respect to said frame in response to actuation of said segments to forcibly engage said pile around the outer circumference thereof and to accommodate radial displacement of said slip bowl.

14. A slip assembly for interconnecting a subsea template or the like to a support pile extending toward the seabed for supporting said template in a preselected position relative to said seabed, said slip assembly comprising:

a frame including means defining a receptacle for receiving a pile extending longitudinally through said frame, said frame including flange means for supporting said slip assembly on complementary flange means on said template;

a slip bowl comprising a member having a downward facing conical surface having a central axis and forming a receptacle for receiving a plurality of slip segments, said slip bowl member being loosely journalled on said frame for limited radial movemnt to substantially align the central axis of said conical surface with the central axis of a pile disposed through said slip assembly;

a plurality of slip segments having outward and upward facing conical surfaces for engagement with said slip bowl to force said segments into gripping engagement with said pile;

fluid operated cylinder and piston actuator means disposed on said frame below said slip bowl and operably connected to said segments by link means for moving said segments axially to engage said slip bowl whereby said segments are moved radially into gripping engagement with said pile in response to actuation of said actuator means; and sleeve means on said frame disposed around said pile and between said pile and said actuator means, said sleeve means extending upward above said flange means on said slip assembly for supporting a running tool to prevent drill cuttings from being forced into said receptacle in the vicinity of said actuator means.

15. In combination, a subsea template for use in subsea well drilling and production operations, said template comprising a frame including a plurality of spaced apart, substantially vertically extending pile receiving sleeves, hydraulically actuated slip assemblies mounted on selected ones of said sleeves for gripping engagement with generally cylindrical piles extending through respective ones of said selected ones of said sleeves and downward to a seabed below said template whereby said template may be supported with respect to said seabed in a predetermined position and on said piles, each of said slip assemblies being characterized by a frame including means for supporting said slip assembly on said sleeve, a slip bowl supported on said frame for limited movement with respect to said frame to accommodate misalignment of said pile with respect to the central axis of said slip assembly and including means forming a surface for engaging slip means for forcing said slip means into gripping engagement with said pile, and fluid operated actuator means for moving said slip means with respect to said slip bowl for forcibly engage said pile in response to introduction of pressure fluid to said actuator means.

* * * * *